US007146970B2

(12) United States Patent
Everingham et al.

(10) Patent No.: US 7,146,970 B2
(45) Date of Patent: Dec. 12, 2006

(54) INTEGRATED VAPOR CONTROL VALVE AND SENSOR

(75) Inventors: Gary M. Everingham, Ontario (CA); Andre Veinotte, Ontario (CA)

(73) Assignee: Siemens VDO Automotive, Inc., Chatham (CA)

( * ) Notice: Subject to any disclaimer, the term of this patent is extended or adjusted under 35 U.S.C. 154(b) by 3 days.

(21) Appl. No.: 10/898,190

(22) Filed: Jul. 26, 2004

(65) Prior Publication Data

US 2005/0016505 A1 Jan. 27, 2005

Related U.S. Application Data

(60) Provisional application No. 60/490,328, filed on Jul. 25, 2003.

(51) Int. Cl.
*F02M 33/04* (2006.01)
*F02M 33/02* (2006.01)

(52) U.S. Cl. ..... 123/520; 123/494

(58) Field of Classification Search ..... 123/520, 123/494; 73/861
See application file for complete search history.

(56) References Cited

U.S. PATENT DOCUMENTS 4,703,737 A * 11/1987 Cook et al. ..... 123/520
5,373,822 A * 12/1994 Thompson ..... 123/520
5,630,403 A * 5/1997 Van Kampen et al. ..... 123/520
5,636,621 A 6/1997 Maki et al.
5,670,949 A 9/1997 Kirby et al.
5,957,113 A 9/1999 Masaki et al.
6,293,261 B1 9/2001 Oemcke et al.
6,302,144 B1 10/2001 Graham et al.
6,326,228 B1 12/2001 Hughes et al.
6,659,087 B1 12/2003 Reddy
2003/0000505 A1 1/2003 Hauke et al.

FOREIGN PATENT DOCUMENTS

JP 06185418 7/1994

* cited by examiner

*Primary Examiner*—Mahmoud Gimie

(57) ABSTRACT

An evaporative fuel vapor control system, purge valve and methods are described. The system includes a fuel supply, internal combustion engine, vapor canister, a bypass passage, and a purge valve. The bypass passage includes a sensor disposed in the bypass passage and in communication with the flow passage to provide a signal indicative of the magnitude of chemicals in the fuel vapor being provided to the engine. Various methodologies relating the system, purge valve and sensors are described.

12 Claims, 2 Drawing Sheets

INTEGRATED VAPOR CONTROL VALVE AND SENSOR

PRIORITY

This application claims the benefits under 35 U.S.C. § 119 of U.S. Provisional Patent Application Ser. No. 60/490,328, filed on 25 Jul. 2003, entitled "Vapor Canister Hydrocarbon Sensor," which application is hereby incorporated by reference in its entirety into this application.

BACKGROUND OF THE INVENTION

Automobiles powered by an internal combustion engines not only emit pollutant emissions via combustion of fuel or via emission of lubricant or fuel in the crankcase, they also produce hydrocarbon emissions via evaporation of fuel stored in the automobiles. It is believed that approximately 20% of all hydrocarbon (HC) emissions from the automobile originate from evaporative sources. To reduce or eliminate this form of emission, modern automobiles store the fuel vapor in a canister and control its release from the canister into the combustion chamber for combustion. Such on-board evaporative emission control system (EVAP) typically includes a charcoal type vapor canister that collects vapor emitted from a fuel tank and a vapor control valve that regulates the amount of vapor permitted to be released from the canister to the engine. The EVAP system is designed to be fully enclosed so as to maintain stable fuel tank pressures without allowing fuel vapors to escape to the atmosphere.

Fuel vapor is generally created in the fuel tank as a result of evaporation. It is then transferred to the EVAP system charcoal canister when tank vapor pressures become excessive. When operating conditions can tolerate additional enrichment, these stored fuel vapors are purged into the intake manifold and added to the incoming air/fuel mixture. The EVAP system delivers these vapors to the intake manifold to be burned with the normal air/fuel mixture. This fuel vapor from the canister is added to the combustion chambers during periods of closed loop operation of the engine when the additional enrichment can be managed by the closed loop fuel control system.

It is believed that inaccurate control of the vapor control valve of the EVAP system may cause rich driveability problems, as well as failure of the various idle speed tests or enhanced I/M evaporative pressure or purge test. That is, a determination of when to permit fuel vapor to be purged to the engine is believed to be problematic due to the wide variations in the volume of fuel vapors produced in the tank that arises from various factors such as, for example, ambient temperature, pressure, fuel mixture or the volume of fuel in the tank. Moreover, the concentration of hydrocarbons or other chemical constituents in fuel vapor may vary greatly depending on these factors. Also, the amount of latent energy stored in the fuel vapor may influence the driveability and exhaust emission of the vehicle. And inappropriate over or under purging of the vapor canister may reduce efficiency or even failure of the canister.

SUMMARY OF THE INVENTION

There is provided, in one aspect of the present invention, an evaporative fuel vapor control system. The system includes a fuel supply, internal combustion engine, vapor canister, a vapor control valve, a passage, and a sensor. The fuel in the fuel supply generates vapor in the supply. The engine is supplied with fuel from the fuel supply. The internal combustion engine has respective intake and exhaust manifolds. The vapor canister includes a vapor passage disposed in fluid communication with the fuel supply to absorb fuel vapor from the fuel supply and a vent passage disposed in selective fluid communication with one of the intake and exhaust manifolds to release fuel vapor to the engine. The vapor control valve is disposed in the vent passage between the engine and the vapor canister. The bypass passage has an inlet and an outlet in fluid communication with the vent passage. The sensor is disposed in the bypass passage to provide a signal indicative of the magnitude of chemicals in the fuel vapor being provided to the engine.

In yet another aspect, a fuel vapor control valve is provided. The fuel vapor control valve includes a body housing and a sensor. The body housing has an inlet and an outlet that define a flow passage between the inlet and outlet. The inlet is coupled to a fuel vapor canister, and the outlet is coupled to one of an intake or exhaust manifold of an engine. The body housing defines a fixed interior volume of the valve. The bypass passage has an inlet and an outlet in fluid communication with the flow passage. The sensor is disposed in the bypass passage so that the sensor provides a signal indicative of a magnitude of chemicals present in the fuel vapor.

In another aspect of the invention, a method of determining chemical content of fuel vapor in a vapor control valve is provided. The vapor control valve includes a body housing that surrounds a flow passage through the vapor control valve between an inlet and an outlet. The method can be achieved by extracting a portion of the fuel vapor between the inlet and outlet; and sampling the extracted portion to indicate a magnitude of chemicals present in the fuel vapor in the flow passage.

In a further aspect of the invention, a method of controlling an evaporative fuel emission system is provided. The emission system includes a fuel supply coupled to an internal combustion engine via fuel injectors, a vapor canister and a vapor control valve. The internal combustion engine has respective intake and exhaust manifolds. The vapor canister has a vapor passage disposed in fluid communication with the fuel supply to absorb fuel vapor from the fuel supply. The vapor canister has a vent passage disposed in selective fluid communication with one of the intake and exhaust manifolds to release fuel vapor to the engine, and a vapor control valve disposed in the vent passage between the engine and the vapor canister. The method can be achieved by bypassing a portion of fuel vapor being provided to the vapor control valve; determining a chemical content of the portion of the fuel vapor; and controlling one of the vapor control valve and fuel injectors based on a chemical content of the portion of the fuel vapor.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENT

Figure 1:
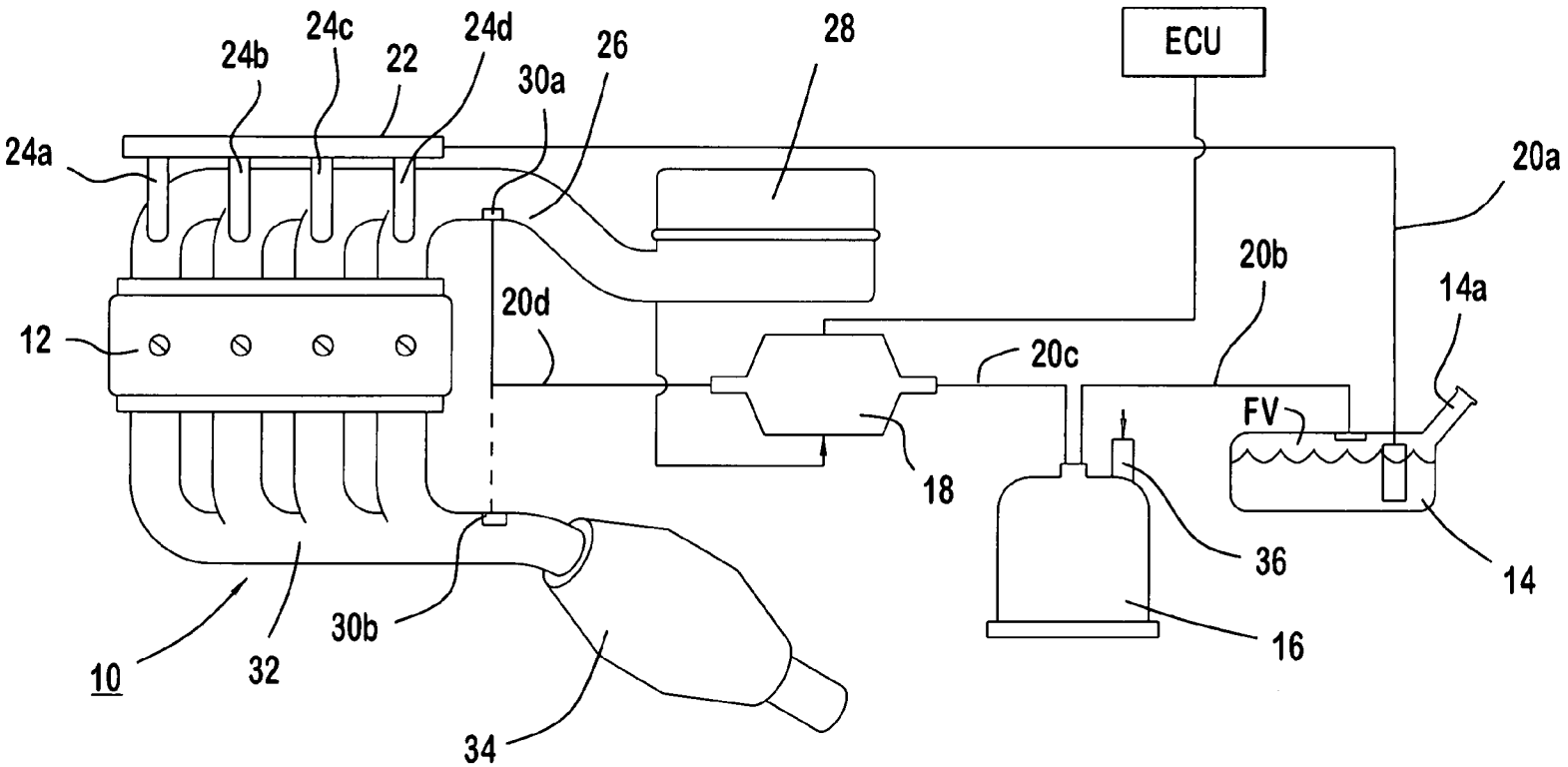
FIG. 1 illustrates a schematic form of a preferred evaporative emission system in a vehicle.
Figure 2:
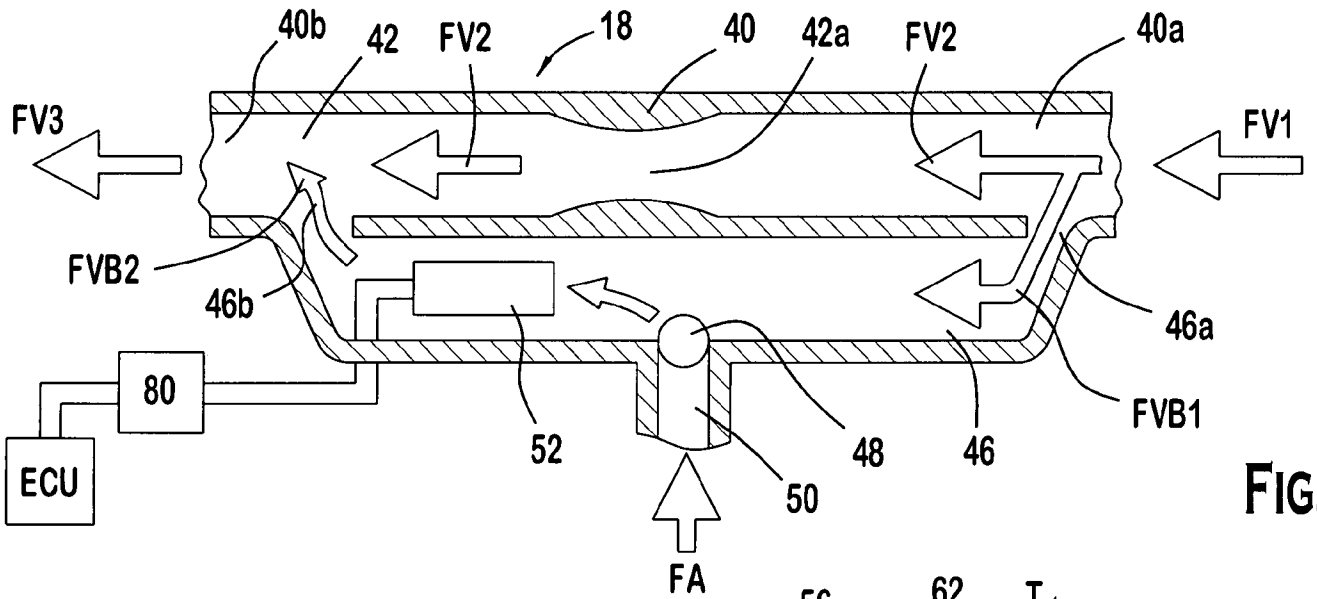
FIG. 2 illustrates in schematic form a vapor control valve of a preferred embodiment.
Figure 3:
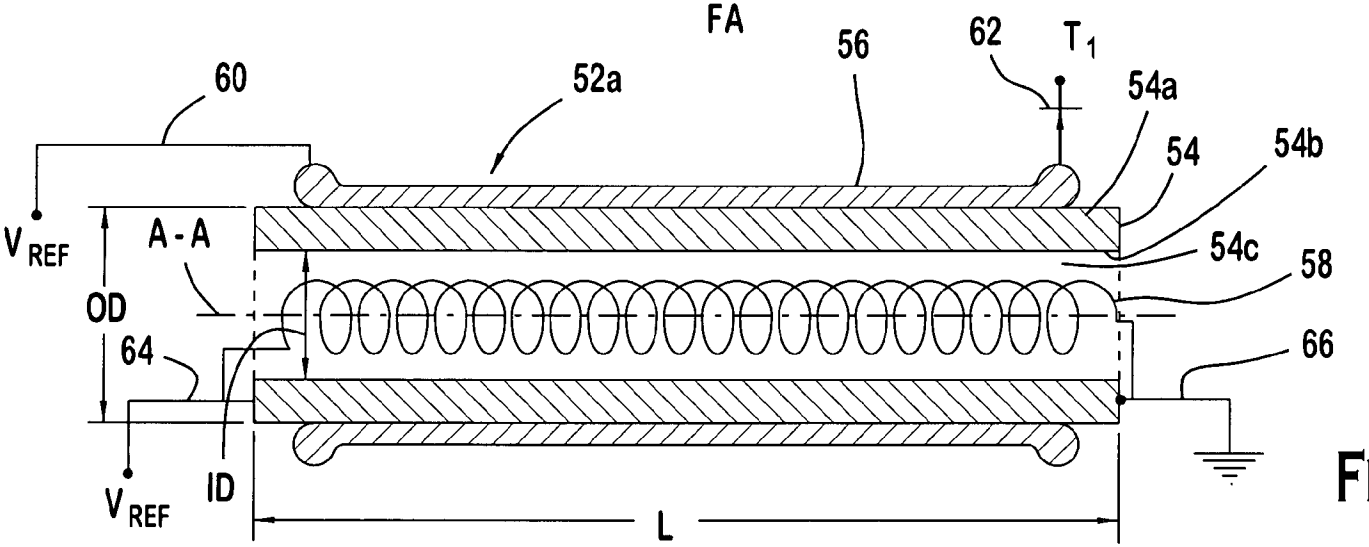
FIG. 3 illustrates a metal-oxide sensor of the vapor control valve.

FIGS. 1–3 illustrate the preferred embodiments. Referring to FIG. 1, an evaporative fuel vapor control system 10 according to a preferred embodiment is shown. In particular, the system 10 includes an internal combustion engine 12, a fuel supply 14, a vapor canister 16 and a vapor control or purge valve 18.

The fuel supply 14 can be a suitable fuel tank 14*a* that stores fuel and vapors formed or generated in the fuel tank 14*a*. The internal combustion engine 12 can be supplied with fuel from the fuel supply 14 via suitable fuel supply conduits 20*a* to a fuel rail 22 for injection into the engine 12 by respective fuel injectors 24*a*, 24*b*, 24*c*, 24*d*.

The internal combustion engine 12 includes an intake manifold 26 in which the fuel injector outlets are mounted therein to dispense fuel into the intake manifold 26. Alternatively, high-pressure, direct injection fuel injectors can be mounted directly to the cylinder head of the engine 12 in pressure direct injection applications. The intake manifold 26 is coupled to an intake air box 28 that provides filtered air for combustion by the engine 12. A purge port 30*a* can be provided on the intake manifold 26 so that fuel vapors from the fuel tank 14*a* can be vented to the intake manifold 26 for combustion. Alternatively, a port 30*b* can be provided for the exhaust manifold 32 so that fuel vapors can be used to achieve a light-off temperature for 2faster catalytic in a close-coupled catalytic converter 34. The engine 12 includes an exhaust manifold 32 coupled to an exhaust catalytic converter 34.

The vapor canister 16 includes a vapor passage 20*b* disposed in fluid communication with the fuel supply 14 to absorb fuel vapor from the fuel supply 14. The vapor canister 16 includes a vent passage 20*d* disposed in selective fluid communication with one of the intake manifold 26 and exhaust manifold 32 to release fuel vapor to the engine 12 via the purge valve. A fresh air vent or inlet 36 is provided to replace the volume of fuel vapor being purged into the engine 12. Preferably, the vapor canister 16 is a charcoal type canister with a fresh air inlet 36.

The purge valve 18 is disposed in the vent passage 20*d* between the engine 12 and the vapor canister 16. Referring to FIG. 3, the purge valve 18 includes a body housing 40 that surrounds a flow passage 42 extending through the purge valve. The body housing 40 of the purge valve 18 includes an inlet 40*a* and an outlet 40*b* that define the flow passage 42 between the inlet 40*a* and outlet 40*b*. The inlet 40*a* can be coupled to a fuel vapor canister 16, and the outlet 40*b* can be coupled to one of the intake 26 or exhaust manifold 32 of the engine 12. The body housing 40 can include a closure member that permits flow of fuel vapor to the engine 12 in a first position and prevents a flow of fuel vapor to the engine 12 in a second position of the closure member 44. The body housing 40 can also be formed separately from the purge valve 18 and can be part of the vent passage 20*c* or vent passage 20*d*.

The body housing 40 also includes a bypass passage 46 in fluid communication with inlet 40*a*, outlet 40*b* and a bypass port 50. The bypass port 50 can provide air essentially free of fuel vapor for dilution with fuel vapor in the flow passage 42. The bypass port 50 can include a closure member that regulates a flow of air into the bypass passage 46 such as, for example, a one-way check valve 48.

The purge valve 18 of the preferred embodiment includes a sensor 52 disposed in the body housing 40 of the purge valve 18 and in communication with the flow passage 42. The sensor 52 can provide a signal indicative of the magnitude of chemicals in the fuel vapor being provided to the engine 12. The sensor 52 can be a semiconductor sensor.

One example of sensors includes a sensor 52 that responds to changes in the partial pressure of oxygen and requires elevated temperatures to induce combustion of chemical vapors to change the resistance of a metal-oxide 56 such as, for example, tin-oxide, which can be doped with other elements such as, for example, indium. The metal-oxide sensor 52*a* can be formed in any configuration such as, for example, a tubular configuration, shown here schematically in FIG. 3. In such configuration, the tube 54 can be formed of a suitable member, such as, for example, ceramics with the metal-oxide 56 sintered on the outer surface 54*a* of the tube 54. A heating element, such as, for example, a nickel-chromium coil wire 58, can be located through the center of the tube 54. Electrical terminals 60 and 62 can be provided for sensing the change in the resistance of the metal-oxide 56. Terminals 64 and 66 can be used to energize the heating element. When the metal-oxide 56 is heated, oxygen, supplied from an external air source such as port 50, can be adsorbed on the surface of the metal-oxide 56 with a negative charge. Donor electrons are then transferred to the adsorbed oxygen thereby causing the layers of metal-oxide 56 to be positively charged. A referential voltage $V_{ref}$ can be provided to the metal-oxide 56 and a resistance to the flow of the referential voltage $V_{ref}$ is believed to be caused by the negatively charged oxygen at grain boundaries of the metal-oxide 56. In the presence of reducing chemicals, catalyzed combustion occurs such that the amount of negatively charged oxygen is reduced. Hence, the resistance to the flow of the referential voltage $V_{ref}$ is decreased, which can be measured to reflect the concentration level of chemicals in the fuel vapor.

Preferably, the sensor 52 is disposed in the flow passage 42 of the purge valve 18 (FIG. 3) and can be any sensor having the capability to detect approximately zero to at least 5000 parts-per-million concentration of hydrocarbon in a fuel vapor environment of about 95% hydrocarbon vapor. In a preferred embodiment, the sensor is an essentially tin-oxide sensor.

Where the sensor 52 being utilized is an essentially tin-oxide sensor 52*a*, the purge valve 18 is preferably one in which a bypass flow passage 46 is provided. The purge valve 18 includes a bypass air port 50 that delivers filtered atmospheric air FA to the bypass passage 46 for dilution of the fuel vapor FV1 from the vapor canister 16 and for adsorption by the essentially tin-oxide sensor 52*a*. Due to the check valve 48, leakage of the fuel vapor in the bypass passage 46 is prevented. In the preferred bypass passage 46, a cross-sectional area of a bypass inlet orifice 46*a* is configured so that only 0.5 percent of the fuel vapor from the purge valve 18 inlet 40*a* is diverted into the bypass flow passage 46. To facilitate the ingress of the diverted fuel vapor, a restriction orifice 42*a* in the form of a venturi is provided in the flow passage 42 of the purge valve 18 to induce a pressure drop across the restriction orifice 42*a*. That is, as the closure member 44 of the purge valve 18 is controlled to an open position that permits flow of fuel vapor FV3 to the engine 12, a negative pressure is provided proximate the outlet 40*b* of the purge valve 18 so that the check valve 48 for the bypass air port is cracked to an open position. The bypass air port 50 is configured such the volume of fresh air FA is about 5 percent of the fuel vapor FV1 provided to the inlet 40*a* of the purge valve. The fresh-air volume FA is provided for dilution with the diverted or bypassed portion FVB1 of fuel vapor in the bypass passage 46. The diluted fuel vapor FVB2 thus flows downstream of the bypass port 50 past the sensor 52. The diluted fuel vapor FVB2 rejoins the flow of fuel vapor FV2 through restriction orifice 46*b* so that the combined volume of fuel vapor FV3 is generally the sum of FV2, FVB1 and FA. In a preferred configuration, as shown in FIGS. 2 and 3, the sensor 52 is a essentially tin-oxide sensor 52*a* that includes an elongated member 54 extending from a first end to a second along a longitudinal axis A—A. The elongated member 54 has an inner surface 54*b* and an outer surface 54*a* cincturing the longitudinal axis A—A to define a passageway 54*c*. A heating element 58 is disposed in the passageway 54*c* and electrically connected to a power source (e.g., vehicle electrical system).

As shown in FIG. 3, the elongated member preferably is a generally circular ceramic tube 54 with a length of about 3.5 millimeters, an outer diameter OD of about 1.4 millimeters with a through opening having a diameter ID of about 0.8 millimeters.

A terminal T1 is provided for sensing the conductivity of the tin-oxide element 56. A referential voltage $V_{ref}$ is also provided to provide a flow of electrons through the tin-oxide element 56 for sensing by the terminal T1. The terminal T1 can be interconnected with the purge valve, fuel pump, fuel injectors, air pump and other actuated devices to the vehicle control unit ECU via a suitable connection such as, for example, a direct connection or via a network 80 based on a suitable interconnected master-slave network protocol (e.g., Controller-Area-Network, a Local-Interconnect-Network, Time-Triggered Protocol for Class A applications). Alternatively, the output from sensor 52 can be configured, as appropriate, to provide a control signal for pulse-width or frequency modulation of the purge valve 18 or other vehicle emission related devices such as, for example, the fuel injectors, fuel pump, fuel pressure regulator and ignition system.

In operation, fuel vapor FV is generated in the fuel supply 14 due to various conditions such as the ambient temperature or the volatility characteristics of the fuel. Build up of fuel vapor FV in a headspace of the fuel supply 14 forces the fuel vapor FV to flow toward the vapor canister 16 via vent conduit 20*c*. The vapor canister 16 absorbs the fuel vapor so that the fuel vapor is generally not released to the atmosphere. As the vapor canister 16 absorbs more and more of the fuel vapor, it may become necessary to purge the stored vapors at some point during the operation of the engine 12. To determine the appropriate conditions at which to purge the vapor canister 16 without affecting the drivability or controllability of the engine 12, the vehicle control computer ECU can sense, via the sensor 52, the concentration of various chemicals (e.g., hydrocarbons) in the fuel vapor and determine whether to purge via vent passage 20*d* and if the canister should be purged, the duration of the purging of the fuel vapor into the engine intake or exhaust.

It is believed that a determination of when to purge, based on real-time sensing of the chemical content of fuel vapor, as described herein, provides several advantages: (1) fuel consumption is reduced due to the ability to determine an appropriate concentration of fuel vapor being added into the engine 12 while reducing the amount of fuel being dispensed via the fuel injectors; (2) a reduction in cold-start emission by purging an appropriate concentration of fuel into the exhaust manifold 32 so that catalytic light-off of the catalytic converter 34 can be achieved before the engine 12 is fully warmed up to operating temperatures; (3) a reduction of hydrocarbons being emitted due to a high concentration of fuel vapor being purged into the engine 12; (4) a reduction in the size of the catalytic converted due to the ability of the preferred embodiments to precisely determine the chemical content of the fuel vapor for air-fuel mixture control; (5) a reduction in engine stumble due to a spike in high concentration of hydrocarbon vapor being purged; and (6) a potential extension in the lifespan of the vapor canister 16 due to a reduction in overpurging of the canister that may introduce unwanted contaminants into the canister via the canister vent inlet 36.

Moreover, in pursuit of these advantages, various methodologies relating to evaporative emission control can be achieved. In particular, a method to determine the chemical content of the fuel vapor FV1 in the purge valve 18 is provided. The method can be achieved by extracting a portion of the fuel vapor between the inlet 40*a* and outlet 40*b*; and sampling the portion to indicate a magnitude of chemicals present in the fuel vapor in the flow passage 42. In extracting the portion of the fuel flow, about 0.5 percent of the fuel vapor flowing from the vapor canister 16 is diverted to a bypass flow passage 46 via orifice 46*a*. In order to sample the diverted portion of fuel vapor, the method includes locating a sensor in a bypass passage 46 proximate the flow passage 42 to provide a signal indicative of a magnitude of chemicals present in the fuel vapor FV1 or FVB1 in one of the respective flow and bypass passages. The method includes diluting the approximately 0.5 percent (and more particularly, 0.52 percent) by volume of the fuel vapor with air volume having a volume of 5 percent of the fuel vapor flowing through the inlet 40*a* and saturating the fuel vapor with the air volume prior to being delivered to the sensor 52. The diluted fuel vapor is added to the fuel vapor FV2 in the flow passage 42 via orifice 46*b*.

Further, a method of controlling an evaporative fuel emission system 10 is also provided. The method includes bypassing a portion of fuel vapor being provided to the purge valve; determining a chemical content of the portion of the fuel vapor; and controlling one of the purge valve 18 and fuel injectors based on a chemical content of the portion of the fuel vapor.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What we claim is:

1. An evaporative fuel vapor control system comprising:

a fuel supply having fuel that generates fuel vapor in the supply;

an internal combustion engine being supplied with fuel from the fuel supply, the internal combustion engine having respective intake and exhaust manifolds;

a vapor canister having a vapor passage disposed in fluid communication with the fuel supply to absorb fuel vapor from the fuel supply and having a vent passage disposed in selective fluid communication with one of the intake and exhaust manifolds to release fuel vapor to the engine;

a vapor control valve disposed in the vent passage between the engine and the vapor canister;

a sensor disposed in the bypass passage to provide a signal indicative of the magnitude of chemicals in the fuel vapor being provided to the engine; and wherein the vapor control valve includes a body housing comprising an inlet and an outlet that define the flow passage between the inlet and outlet, the inlet being coupled to the fuel vapor canister, and the outlet being coupled to one of the intake or exhaust manifold of the engine, and wherein the bypass passage comprises a bypass port to provide air essentially free of fuel vapor from the bypass port for dilution with fuel vapor in the vent passage, the bypass passage being in fluid communication with the inlet and outlet of the vapor control valve and so that the sensor is located in the bypass passage downstream of the bypass port in the flow of fuel vapor.

2. The system of claim 1, wherein the flow passage includes a closure member that permits flow of fuel vapor to the engine in a first position and prevents a flow of fuel vapor to the engine in a second position of the closure member.

3. The system of claim 2, wherein the bypass port comprises a closure member that regulates a flow of air into the bypass passage.

4. The system of claim 3, wherein the sensor comprises a solid-state semiconductor sensor.

5. The system of claim 4, wherein the semiconductor sensor comprises:

an elongated member extending from a first end to a second along a longitudinal axis, the elongated member having an inner surface and an outer surface cincturing the longitudinal axis to define a passageway;

a heating element disposed in the passageway, the heating element configured to be electrically connected to a power source; and a layer of essentially tin-oxide disposed on the outer surface of the elongated member so that an electrical conductivity of the layer of the essentially tin-oxide is changed in the presence of chemicals in the fuel vapor.

6. The system of claim 5, wherein the elongated member comprises a generally circular ceramic tube having a length of about 3.5 millimeters, an outer diameter of about 1.4 millimeters with a through opening having a diameter of about 0.8 millimeters.

7. An evaporative fuel vapor control system comprising:

a fuel supply having fuel that generates fuel vapor in the supply;

an internal combustion engine being supplied with fuel from the fuel supply, the internal combustion engine having respective intake and exhaust manifolds;

a vapor canister having a vapor passage disposed in fluid communication with the fuel supply to absorb fuel vapor from the fuel supply and having a vent passage disposed in selective fluid communication with one of the intake and exhaust manifolds to release fuel vapor to the engine;

a vapor control valve disposed in the vent passage between the engine and the vapor canister;

a bypass passage having an inlet and an outlet in fluid communication with the vent passage, the bypass passage including a bypass port to provide air; and a sensor disposed in the bypass passage to provide a signal indicative of the magnitude of chemicals in the fuel vapor being provided to the engine;

wherein the bypass passage comprises a bypass passage located within a fixed interior volume defined by a body housing of the vapor control valve.

8. A fuel vapor control valve comprising:

a body housing having an inlet and an outlet that define a flow passage between the inlet and outlet, the inlet being coupled to a fuel vapor canister, and the outlet being coupled to one of an intake or exhaust manifold of an engine, the body housing defining a fixed interior volume of the valve;

a bypass passage having an inlet and an outlet in fluid communication with the flow passage, the bypass passage having a bypass port to provide air; and a sensor disposed in the bypass passage so that the sensor provides a signal indicative of a magnitude of chemicals present in the fuel vapor;

wherein the sensor comprises a semiconductor sensor, and wherein the bypass passage is located within the fixed interior volume; and wherein the semiconductor sensor comprises:

an elongated member extending from a first end to a second along a longitudinal axis, the elongated member having an inner surface and an outer surface cincturing the longitudinal axis to define a passageway;

a heating element disposed in the passageway, the heating element configured to be electrically connected to a power source; and a layer of essentially tin-oxide disposed on the outer surface of the elongated member so that an electrical conductivity of the layer of essentially tin-oxide is changed in the presence of chemicals.

9. The fuel vapor control valve of claim 8, wherein the inlet further comprises a closure member that regulates a flow of fuel vapor to the flow passage.

10. The fuel vapor control valve of claim 8, wherein the outlet further comprises a closure member that regulates a flow of fuel vapor from the flow passage to the engine.

11. The fuel vapor control valve of claim 8, wherein the bypass port comprises a closure member that regulates a flow of air into the bypass passage.

12. The fuel vapor control valve of claim 8, wherein the elongated member comprises a generally circular ceramic tube having a length of about 3.5 millimeters, an outer diameter of about 1.4 millimeters with a through opening having a diameter of about 0.8 millimeters.

* * * * *